US006367180B2

(12) United States Patent
Weiss et al.

(10) Patent No.: US 6,367,180 B2
(45) Date of Patent: Apr. 9, 2002

(54) ELECTRONIC ILLUMINATED HOUSE SIGN

(76) Inventors: Richard S. Weiss, 15 Court Sq., Boston, MA (US) 02108; Richard Eckhardt, 51 Lockeland Ave., Arlington, MA (US) 02476; Sol Aisenberg, 36 Bradford Rd., Natick, MA (US) 01760

( * ) Notice: Subject to any disclaimer, the term of this patent is extended or adjusted under 35 U.S.C. 154(b) by 0 days.

(21) Appl. No.: 09/753,890

(22) Filed: Jan. 3, 2001

Related U.S. Application Data

(63) Continuation-in-part of application No. 09/632,237, filed on Aug. 3, 2000.

(51) Int. Cl.[7] ..... G09F 13/06; G09F 13/22
(52) U.S. Cl. ..... 40/580; 40/564; 40/544
(58) Field of Search ..... 40/580, 564, 541, 40/544

(56) References Cited

U.S. PATENT DOCUMENTS 2,152,845 A * 4/1939 Hays ..... 40/580
4,466,208 A * 8/1984 Logan, Jr. et al. ..... 40/544
4,486,820 A * 12/1984 Baba et al. ..... 362/183
5,105,568 A * 4/1992 Branning ..... 40/570
5,485,145 A * 1/1996 Sniff ..... 40/544
6,060,838 A * 5/2000 Cantoni et al. ..... 315/159

* cited by examiner

*Primary Examiner*—Cassandra H. Davis
(74) *Attorney, Agent, or Firm*—Mark P. White

(57) ABSTRACT

An illuminated sign, readable during the night or day, and suitable for use as a house number display, uses a single illuminatable panel, on which a number of stencils are plac critical flicker frequency ed. Each stencil is a rectangular piece of opaque material, such as plastic or metal, in which a central cutout is made in the shape of a number. Several of these stencils are arrayed in front of the illuminatable panel, so that only the light coming through the central cutouts is visible through the stencils. The illuminatable panel is made of an array of LED's, with a diffuser to produce a uniform illumination, and is powered by one or more batteries. A light detector senses the onset of dusk, which activates the illuminatable panel, turning it on, and leaving it on for four or more hours. A constant-current electronic system powers the LEDs, which are pulsed on and off at a speed greater than 90 Hz, which makes the sign appear to the human eye as constantly illuminated. A timer leaves the illuminatable panel illuminated only for a few hours, in order to maximize the life of the batteries.

16 Claims, 8 Drawing Sheets

ELECTRONIC ILLUMINATED HOUSE SIGN

PROSECUTION HISTORY

This application is a continuation in part of Ser. No. 09/632,237, filed on Aug. 3, 2000 which is incorporated herein by reference.

BACKGROUND OF THE INVENTION

1. Field of the Invention

The present invention relates to a device for visually indicating house numbers during both daylight hours and at night. More specifically, this invention relates to such a device which provides an easy modification for different numbers, and is battery operated but causing a low power drain.

2. Description Relative to the Prior Art

Illuminated house numbering devices are well known, and there is much prior art describing such systems. Typical of these is U.S. Pat. No. 5,007,190, which provides a programmable system which is solar powered, thus allowing the device to be installed without connection to the internal wiring system of the house. The solar cells of this prior art device are used to charge an internal battery during the day, and the battery powers the device at night.

Devices such as the one described above suffer from a common shortcoming however: complexity, resulting in high purchase price, and high maintenance and replacement cost.

Furthermore, many of these devices do not provide a numbering visible during the day, since the typical illuminated characters chosen do not provide a display which is easily discernable during daylight hours.

In U.S. Pat. No. 5,522,540, issued Jun. 4, 1996, to Robert L., Surman, titled "Solar Powered Illuminated Address Number Device and Mailbox Structure", the illumination feature is made part of a mailbox in the teaching and in the independent claims. Also the internal battery is powered by solar energy. This invention has the disadvantage of using solar energy to power the battery and the disadvantage of increased cost. Also it is associated with a mailbox and not necessarily useful in other location such as inside buildings.

The device described herein solves these problems by providing a simple, low-cost and low power consuming system which is visible both during the day and at night. The electronics are simple, and the power drain is quite low. The recharging of the battery(s), when necessary, is done off line, further reducing the cost and complexity of the device. Alternatively, the battery(s) may be simply replaced when discharged.

Our solution employs the use of Light Emitting Diodes, (LEDs) which are very efficient in converting electrical energy into light. Also we use a low duty cycle for the current flow through the LEDs to conserve average energy. Further improved energy utilization is achieved by operating the LEDs in series and by powering then from an efficient blocking oscillator.

Furthermore, our invention extends the life of the internal batteries by using an energy conserving technique of powering the illuminating LEDs with low duty cycle pulses so that the average current and energy drawn from the battery is considerably reduced. The pulses are at a high enough frequency (above the critical flicker fusion frequency) so that the viewed numbers and/or letters appear constant due to the persistence of vision. Included are a number of optional features that make the device more versatile without significantly increasing costs or complexity.

Our invention permits display of the numbers and or messages and with high contrast in daylight.

The advantages of the present device include the simplicity of the power supply which uses standard flashlight batteries, the use of low cost electronics to extend battery life, the ability to easily change address numbers and to use different fonts, and flexibility allowing the display of changeable alphabetic messages such as but not limited to street names, or occupant names.

SUMMARY OF THE INVENTION

It is an object of the current invention to provide a simple, low-cost illuminated multi-digit house sign in which the numbers contained therein are visible both day and night. It is a specific object of the invention to provide such a sign with a modular design, and providing long battery life.

In accordance with one aspect of the present invention, an illuminated sign includes a power source, an illuminatable panel powered by the power source, and one or more opaque stencils each containing cutouts of a character through which the illuminatable panel is visible. Each of the stencils is disposed near the face of the illuminatable panel, so that the sign's appearance is one of illuminated characters corresponding to the stencils when the sign is lighted.

In accordance with a second aspect of the invention, the invention includes switching means to switch power from the power source to the illuminatable panel on and off In accordance with a third aspect of the invention, each stencil also has a background with a background color, and a margin, with a margin color, the margin configured around the cutout. The margin color is different from, and contrasting with, the background color. As a result, the identity of the character is visible even when the illuminatable panel is not illuminated.

In accordance with a fourth aspect of the invention, the power source is a battery.

In accordance with a fifth aspect of the invention, the sign includes a dusk detector and a timer which is activated when the dusk detector detects the onset of dusk and remains activated for an illumination period. As a result, power is switched off from the illuminatable panel except during the illumination period.

In accordance with a sixth aspect of the invention, the sign has a body, and the stencils are retained in the body by slides formed in the body.

In accordance with a seventh aspect of the invention, the illuminatable panel is a florescent illuminatable panel.

In accordance with an eighth aspect of the invention, the illuminatable panel is made up of a substantially equally spaced array of LEDs; a diffuser disposed in front of the illuminatable panel, and one or more opaque stencils each containing cutouts of a character through which the illuminatable panel is visible, each such stencil disposed in proximity to the diffuser.

In accordance with a ninth aspect of the invention, the LEDs are switched on and off at a pulse rate, and after each time the LEDs are switched on they remain on for an on period. Switching means are incorporated to vary the pulse rate, and to vary the duration of the on period.

In accordance with a tenth aspect of the invention, constant current electronic means to are used to illuminate the LEDs.

In accordance with an eleventh aspect of the invention, the diffuser has a whitish color, so that the cutouts in the stencils are easily visible during daylight hours, when the illuminatable panel is not illuminated.

In accordance with a twelfth aspect of the invention, the stencils have a front side and a back side, the front side being dark in color, and the back side having a reflective surface, so that the light from the reflective surface reflects off the diffuser, further illuminating the diffuser.

BRIEF DESCRIPTION OF THE DRAWINGS

These, and further features of the invention, may be better understood with reference to the accompanying specification and drawings depicting the preferred embodiment, in which.

DESCRIPTION OF THE PREFERRED EMBODIMENTS

The invention provides an illuminated sign appropriate for displaying street numbers for residences, and similar uses.

The invention, in its preferred embodiment, is simple and relatively inexpensive, using a single illuminatable panel beneath an array of stencils which cover the illuminatable panel, except where cut out in the shape of various characters, where the term "character" as used in this context is meant to include letters, numbers, and other shapes, whether representing foreign alphabets or simply pictures and images.

Figure 1C:
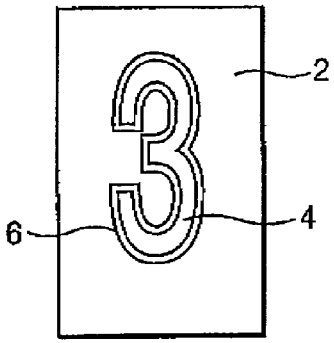
FIG. 1*c* depicts a stencil of the single character "3", with a margin around the cutout to allow a viewer to distinguish the number "3" in daylight conditions.
Figure 1A:
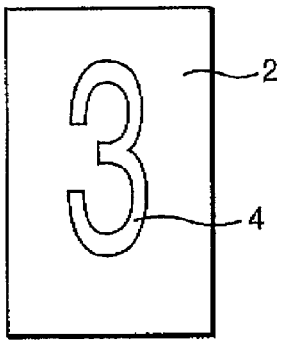
FIG. 1*a* depicts a stencil of a single character, in this case the number "3".

Referring first to FIG. 1*a* a stencil for the number "3" is shown. The stencil contains an opaque background 2, in which the cutout 4 in the shape of the number "3" appears. It is clear that when the stencil is placed in front of an illuminated area, the number "3" will be prominently displayed.

Figure 1B:
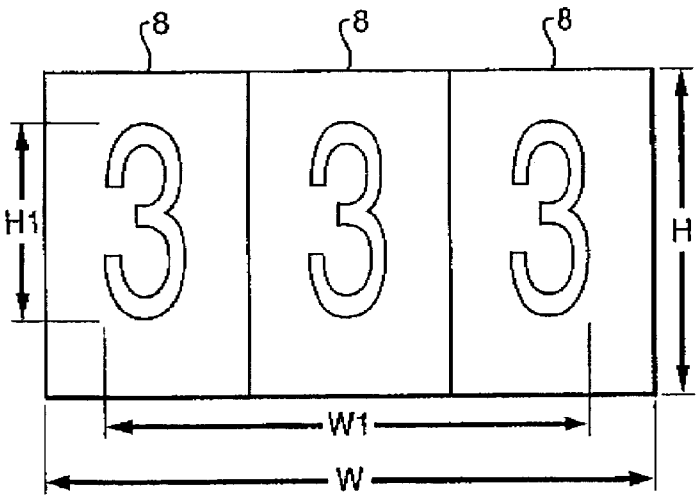
FIG. 1*b* depicts three stencils of the characters "3" arranged together to form the three-digit number "333".

A multi-digit number is created by arranging the appropriate stencils in order, in front of an illuminatable panel of a suitable type. Referring now to FIG. 1*b*, three identical stencils 8 containing the number "3" are placed along side each other to form the three-digit number "333". Assuming now that this array of stencils is placed in front of an illuminatable panel of the same size as the array, that is, with width W and height h, the only light seen will be through the cutouts having the shape of the "3s" of the stencils. However, the illuminatable panel need not be this big, to achieve the same effect. Still referring to FIG. 1*b*, the illuminatable panel need only have the dimensions w1 by h1, that is, only large enough to cover the extent of the cutouts in the stencils.

Figure 4:
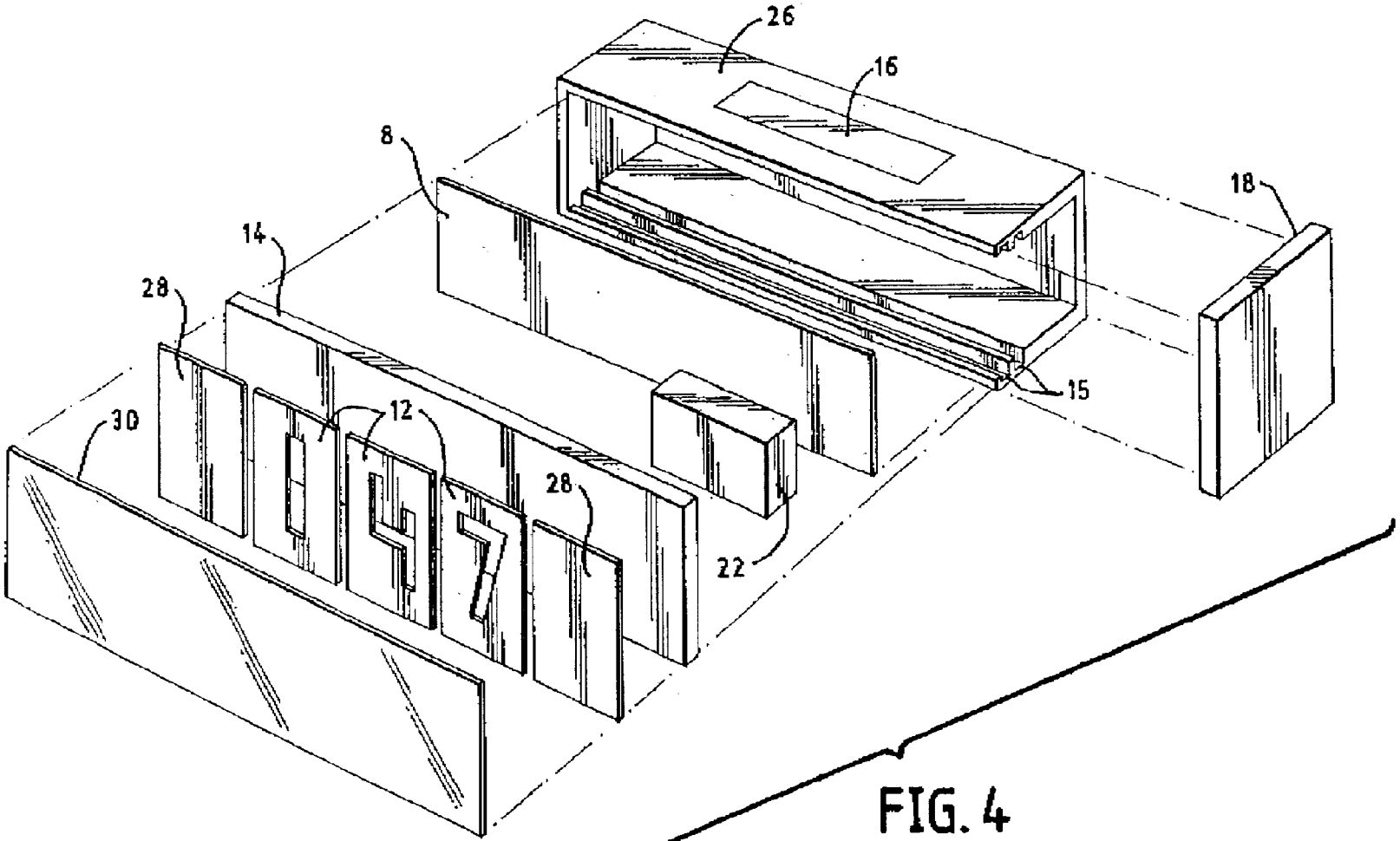
FIG. 4 depicts an exploded view of the first preferred embodiment of the device.

The device is shown in exploded view in FIG. 4. Referring now to this figure, it is seen that the u-shaped housing 26 contains a photo-sensitive element 16 atop the housing, so that it is exposed to the light, and may detect the onset of dusk.

Within the housing are a circuit board 8, and battery 22. Forward of these items is the illuminated panel 14, which is mounted directly behind the grooves 15. The actual stencils 12, together with the blanks 28, are mounted by sliding into the rearmost of the two grooves. A protective glass plate 30 is mounted by sliding in the forward-most of the grooves 15. Finally, when all the aforementioned components are mounted within the housing 26, the lid 18 is affixed to the side of the housing, sealing the device against the weather.

Alternative methods of powering this sign system include using the AC house current, available at the utility outlets of the home. Use of the AC house current does away with the need for the inverter, as well also not requiring the NICAD battery, or the charger circuit. The time would also be unnecessary, and the illuminatable panel could be illuminated from dusk till dawn by means of the photoresistor dusk sensor.

Illuminated panels are currently available in panels of a wide variety of sizes and shapes. The panel contemplated for the current invention would accommodate four digits whose cutout height is four inches, and with a width of 3 inches per digit, or about 12 inches in width. Alternatively, illuminatable panels would be provided in two, three, and four digit sizes. Signs of greater numbers of digits could be constructed by ganging two or more of the smaller-sized signs.

One of the problems not addressed by other lighted house signs is that they do not show up well during daylight hours, even when illuminated. In the present invention, this problem is solved by purely mechanical, non-electronic means. Referring now to Figure 1*c*, the numeral "3" is surrounded by a margin 6 of the same shape. If the color of the stencil background 2 is black, then the margin 6 would be white, or yellow, or another light color which contrasts well with black. As long as the background color 2 and the margin color 6 are contrasting, the digit will be visible during daylight hours.

In the current invention, the stencils may be made of stainless steel, plastic, or any other inexpensive, non corroding material. Flimsy materials such as cardboard, and corroding materials, such as iron, are not suitable for this application, since the sign will be outside, exposed to rain, snow, sunlight, and other such weather conditions.

Types of illuminated panels may be used include fluorescent and incandescent panels, especially when used in the alternative embodiment which is wired directly to the AC house current.

FIRST ALTERNATIVE EMBODIMENT—LED ARRAY ILLUMINATABLE PANEL

The first alternative embodiment can use a transparent plastic enclosure, painted inside to make portions opaque, with clear viewing windows and/or multiple windows, or an opaque enclosure with clear window(s) inserted, or just physical openings, suitable for indoor use. Alternately, numbers/messages can be placed over the opening, and the device can be protected against weather by then covering the opening, numbers/messages with a clear protective cover.

In this embodiment, the illuminatable panel is made up of an LED array, with the LEDs more or less uniformly spaced about the illuminatable panel, and with one or more diffusers to reduce brighter areas and make illumination more uniform. In its simplest form, the diffuser is a frosted pane of glass or milk-white plastic. Other forms of diffusers include glass or plastic with an irregular surface, such as the diffusers used in the taillights of automobiles, which scatter the light internally, and give a more or less uniformly lighted surface. Diffusers may also be reflective in nature, with the reflective surfaces having irregularities that reflect incident light in many different directions, so that the net effective will be to create a more-or-less constant light intensity throughout.

When the illuminatable panel is switched off during daylight hours, and the sign is visible in daylight, the stencil numbers or stencil messages are visible because the light entering the stencil opening is reflected by the whitish appearance of the diffuser behind the stencil cutouts, and the effect produces white characters on a black background.

The interior of the sign enclosure is made of materials which produce reflecting interior surfaces to redirect light back into the diffuser. Thus, when the illuminatable panel is illuminated, the reflections effect a reuse of some of the reflected light through the viewing region.

As in the first embodiment, the housing has internal slides to hold the stencils so that they may be easily installed or changed. As in the first embodiment, a single stencil may contain a series of numbers or characters.

This alternative embodiment pulses the LEDs at a rate which is controlled by the user through switches or similar controls. It is well known that pulsing lights produce a much more energy efficient effect that simply leaving the lights constantly illuminated. In the present embodiment, the LED's are pulsed at a rate faster than the "critical flicker fusion frequency", defined as the frequency beyond which the human eye perceives the flickering light to be continuous. That is, pulsing of a light at greater than 90 Hz is not perceptible as such to the average human. In this embodiment, the pulse rate is about 20,000 Hz, two orders of magnitude beyond the critical flicker fusion frequency. Using such a high pulse frequency provides two advantages: first, the size of the electronic components to provide and control the pulsing are small in size; and second, any vibrations produced by this pulsing, such as vibrations in transformers of the power supply, will be at a frequency generally beyond the hearing range of humans.

In addition to pulsing the LEDs at about 20,000 times per second, the current embodiment also controls the duty cycle of the pulsations. A duty cycle is defined as the ration of on time to off time, expressed as a percentage. Thus, a fifty-percent duty cycle is one in which the illuminatable panel is illuminated for fifty percent of the time. It has shown to be advantages, from an energy efficiency viewpoint, to have a low duty cycle, depending on the state of charge of the batteries. Thus, when the batteries are fresh, the sign may use a twenty-percent duty cycle.

Using a twenty-percent duty cycle, and a 20 kHz pulse rate, the illuminatable panel will be turned on every 50 $\mu$Secs, and will remain on for 10 $\mu$Secs. The result will appear to the average human eye as constant illumination.

The pulse rate and the duty cycle are controllable in the sign of the present embodiment. Furthermore, the sign can be made to flash by turning the power supply on and off at a rate in the order of once per second. This flashing may be used for special occasions, such as for parties or for emergencies. The switching arrangement also allows the sign may be left illuminated during daylight hours for special occasions.

HIGHER EFFICIENCY EXTENDS OPERATING LIFE OF BATTERIES

This alternative embodiment uses a number of power-saving techniques and devices to prolong battery-operating time. These include the use of low power CMOS semiconductors in the logic circuitry of the electronics.

Rather than leaving the sign illuminated all day, continuous detection of light level uses photo detector and low power CMOS trigger circuit to turn on power only when daylight fades at dusk, and will leave the illuminatable panel illuminated only for a fixed, although user configurable, period of time, typically four to six hours, after dusk. Other alternative embodiments provide for a wider range of "on" times, or for a continuously variable setting.

Power is conserved by operating the LEDs in series from a single current source with low loss. Depending upon the configuration of the LEDs, they may be grouped in clusters, each cluster having its own constant current source.

Prior art LED power supplies use constant voltage in series with a resistor, to produce the desired current. The operating voltage of an LED is about 1.8 volts and is nearly constant over a wide range of currents and light intensity. The supply voltage is dependent on the number of batteries used and changes as the batteries are discharged. Thus normally much of the energy is wasted in the series resistor that is used to maintain constant current through the LED. In contrast, the present embodiment, the LEDs are supplied by a means of constant current circuit which does not use the dropping resistor in series with the LED.

There are a variety of semiconductor circuits which can provide the constant current required by the LEDs without the power loss of the dropping resistor approach, but this increases the cost of the device, In this present invention the current is provided to the array of LEDs connected in series and the current is provided by the energy stored in an inductor in series with the LED array. The inductor is operated in the blocking oscillator mode where the circuit is pulsed by means of a semiconductor switch connected in series with the inductor and the power supply. The switch is connected across the series array of LEDs and when the switch is on it permits current to flow into the inductor thus storing energy into the inductor magnetic field. When the switch is opened, the magnetic field collapses thus generating a large flyback voltage from the inductor. This produces a current through the series connected array of LEDs without any power loss in a series resistor. In each pulse, the initial output current from the inductor is essentially the same as the final current used in charging the inductor. The use of this blocking oscillator means for powering a series array of LEDs is largely responsible for the high efficiency and extended operation from the batteries.

The low duty cycle operation of the light sources at rates faster than the critical flicker fusion frequency is also an important contributor to the high efficiency operation and extended operation from the batteries, as previously mentioned. The device thus benefits from the physiological persistence of vision to smooth out the perception of the light pulses.

Another important contribution to the longer operating life from the batteries is the use of a voltage regulator for the output from the batteries. As the batteries reach near end of their capacity and life the output voltage decreases and the output light would normally decrease near the end. By using an efficient voltage regulator, the power supply voltage is maintained more constant thus using more of the remaining battery life to give stable and useful display life.

As a result of the above-described power saving features, it has been found that a device made in accordance with these principles powered by six one and one-half volt batteries draws between 4 mA and 17 mA, depending upon the size of the illuminatable panel. For a sign left on an average of four hours per day, drawing 4 mA, the batteries have been calculated to last approximately two years without replacement or recharging.

INCLUDED CONTROLS

The present embodiment uses an internal dusk (light) sensor to turn device on as dusk approaches.

An internal timer circuit keeps the illuminatable panel illuminated for a fixed time after the onset of dusk, typically four hours. For longer winter nights, the lights can be left on for longer periods, typically six hours. An internal switch is be used to control the "on" time following dusk.

Controls also include a threshold setting control of the dusk detector, to adjust the light level below which the device is turned on. This setting is facilitated by a calibration mode control, allowing the user to wait for an appropriate degree of darkness, at which time he selects the "calibrate" function to determine the light level for activation.

As previously mentioned, the sign can be set into flashing mode for special occasions. A typical rate for such operation is between 2 to 5 flashes per second.

As a further alternative embodiment, a user with more than one electronic sign in accordance with this invention may synchronize two or more by communication between them, including means which include infra-red light signals, rf signals, etc.

The device can have more than one lighted illuminatable panel, each of which can contain different messages. An example can be one panel showing address numbers, and another can display the street name, and another can display the name of the occupants and/or business. Individual display panels or combinations can be independently powered and selected by switches. The device also includes a power on/off switch for storage.

DETAILED DESCRIPTION OF THE EMBODIMENT

Figure 2:
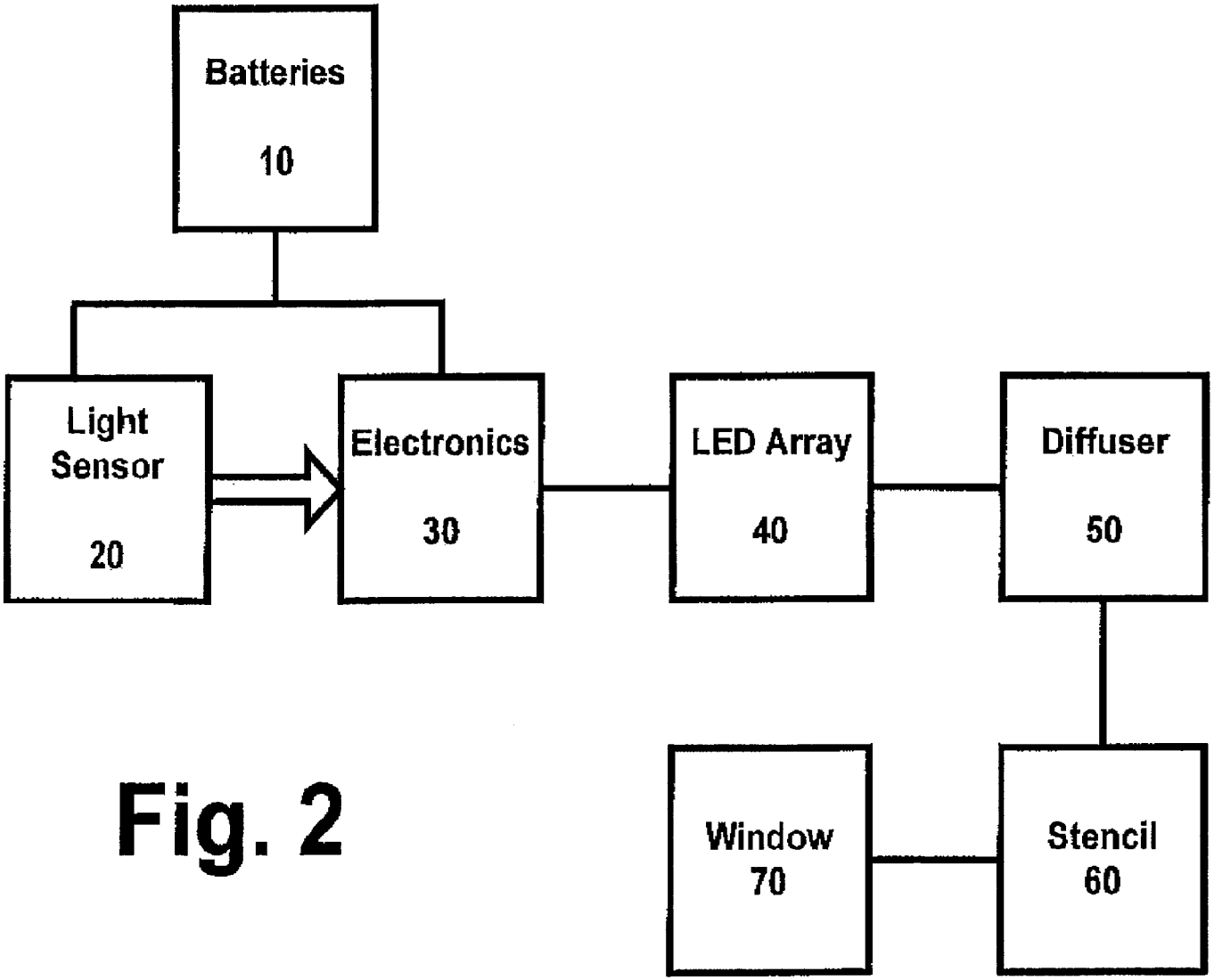
FIG. 2 depicts a block diagram of the alternative embodiment of the current invention.

Referring now to FIG. 2, a block diagram of the device is depicted. Batteries 10 provide continuous standby current at very low levels to a light sensor 20 that is monitored by a low power CMOS threshold circuit, which is part of the electronics 30. The battery(s) 10 also continuously powers the threshold portion of the electronics. The standby current is in the microampere range and only reduces the battery energy and life by a very small amount. When the threshold circuit detects that the light on the light sensor falls below a preset value, the threshold circuit activates power to the rest of the electronics, which energizes the LED array 40. The light from the array passes through a diffuser 50, which makes the light source appear more uniform. The light from the diffuser 50 passes through a stencil 60 that forms numbers, and/or letters in the transmitted light. The light then passes through a transparent window 70 that is used to protect the interior from the weather.

Figure 3:
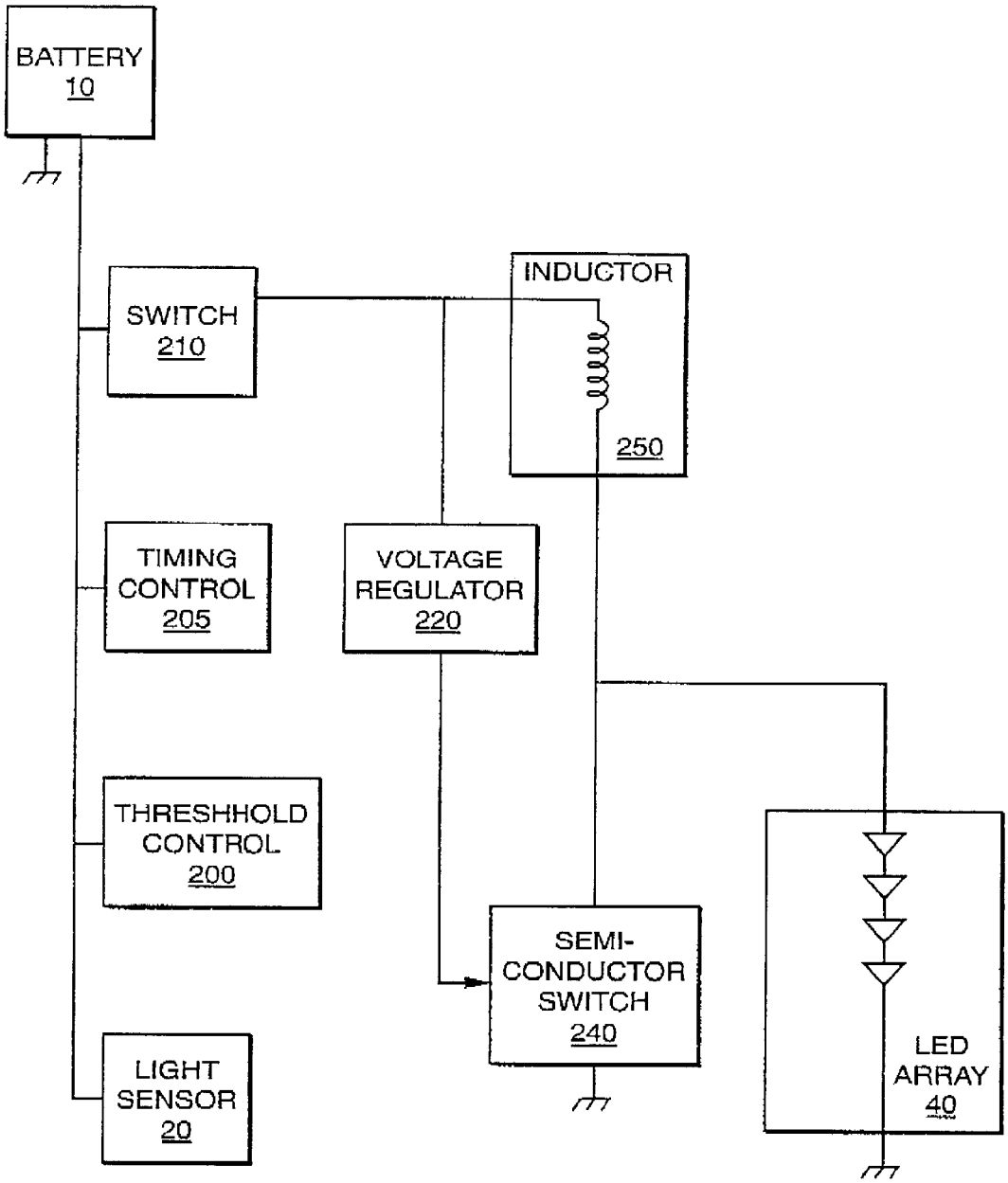
FIG. 3 depicts a circuit diagram of the alternative embodiment of the current invention.

Referring next to FIG. 3, a block diagram of electronic circuit is depicted. Battery 10 provides standby power to the light sensor 20 and the threshold circuit 200. When the threshold circuit detects that the light sensor 20 indicates a low light level corresponding to night or dusk, the threshold sensor 200 activates a timer circuit 205 that activates a switch 210 that applies power to a voltage regulator 220. The voltage regulator compensates in part for the drop in voltage of the battery near end of capacity. Powered by the voltage regulator 220 is a CMOS low power oscillator 230 that operates above the critical flicker fusion frequency. The output of the oscillator 230 turns a semiconductor switch 240 on and off to provide charging current to the inductor 250. When the switch 240 is periodically turned off, the collapsing magnetic field in the inductor 250 produces a large induced voltage that passes current through the LED array 40.

Figures 7A, 7B:
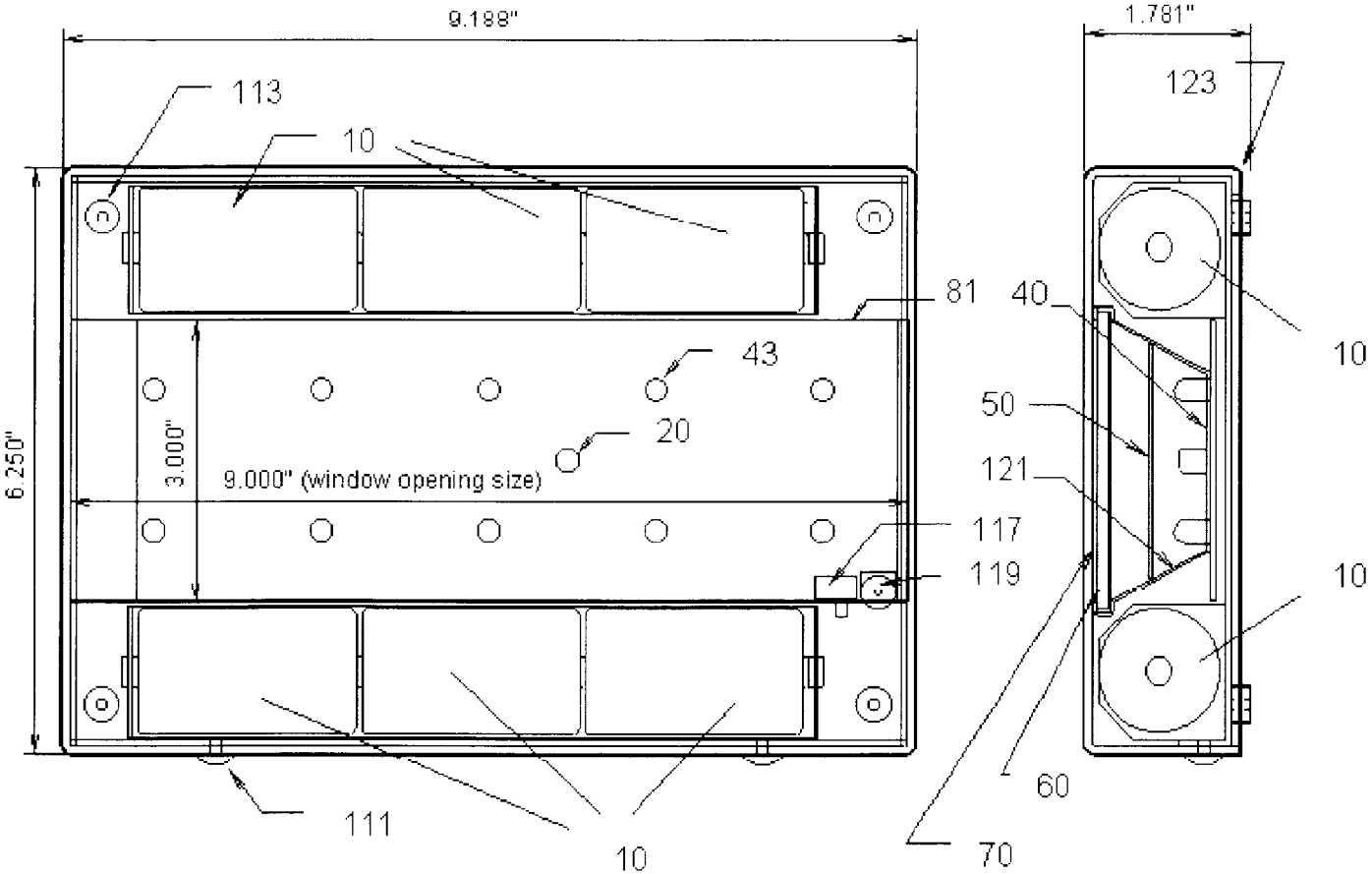
FIG. 7*a* depicts a side elevation view of the first alternative embodiment of the invention.
FIG. 7*b* depicts an end elevation view of the first alternative embodiment of the invention.

Referring next to FIG. 7A, a side elevation drawing of the actually constructed device is shown, and FIG. 7B shows an end elevation view of the device. Referring now to these figures, the device is embodied in an enclosure about 9.2 inches in length by about 6.25 inches in width by about 1.8 inches in thickness. The window through which the stencil is exposed is about 9 inches wide by 3 inches high.

The device is powered by 6 1½ volt "D" cells 10, arranged around the periphery of the enclosure, which is weatherproof, and held on with retaining screws 11. The PC board containing the electronics is mounted on standoffs 113, as is the reflector 121, which intensifies the light by reflecting it back from the back side of the stencil 60, which is a highly reflective surface in this embodiment. The LED array 40 is made up of a number of individual LEDs 43 spaced more or less evenly around the array illuminatable panel. The photosensor 20 is mounted in the plane of the LED array, and contains a filter to reject light of the wavelength of the LEDs of the array. In alternative embodiments the photosensor is mounted on the surface of the enclosure.

Still referring to these figures, a switch 117 allows the user to select the length of illumination of the unit each day, selecting a duration of between 4 and 6 hours. Brightness control 199 allows the user to control the brightness of the display.

Referring now to FIG. 7*b*, it is seen that the number stencils 60 are mounted behind a transparent protective cover70, with diffuser 50 spreading the light evenly over the surface of the stencil. The reflector 121 totally encloses both the area between the stencil and the diffuser, and the area between the diffuser 50 and the illuminatable panel 40.

Figure 8:
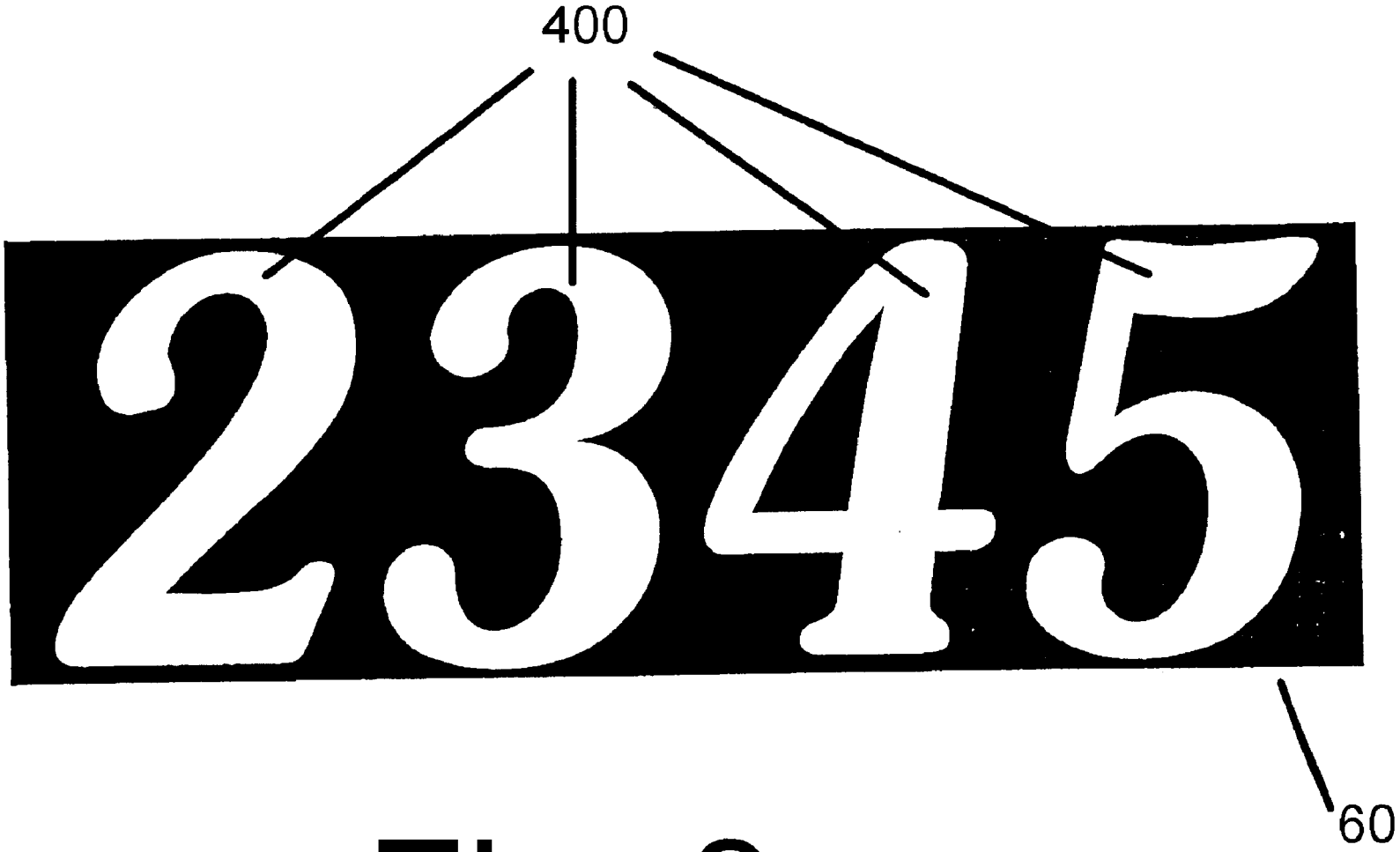
FIG. 8 depicts an exemplary stencil with the numerals "2345" appearing.

Referring now to FIG. 8, an example of address numbers is displayed, where the numbers 400 demonstrate one of the decorative fonts that can be used. The numbers are included in the stencil 60.

Included in this invention is a low cost method of manufacturing the stencils. We have determined that white color of the back of the stencil works nearly as well as a mirrored surface to reflect light. The last stencils made used paper that was white on the back and black on the front. The paper was adhered to a transparent film and the number shapes were cut through the paper (the transparent film keeps the center cutouts of number like "4", "6", and "9" in position).

Stencils like this can be fabricated by first printing the desired pattern (a negative image of the numbers and letters) with white ink on a transparent or translucent film. Then the white ink is overprinted with black ink with the same pattern. In practice the openings in the black ink are very slightly smaller to assure that no white shows through.

The net effect of this process is to create a stencil black on the front, but white on the back to reflect the unused light back onto the white diffuser face. The black on the outside provides the desired contrast for visibility in the daylight. Stencils made this way are very inexpensive to manufacture, as it uses a simple printing process. No die cutting is required, and therefore, no expensive tooling is needed for each font or character size. The diffuser 50 in the cavity behind the stencil opening is white and gives contrast with the black outside of the stencil and this gives visibility in daylight. In some cases, associated with the white diffuser in back of the stencil is another diffuser between the white diffuser and the LED array 40 to pre diffuses the light from the LEDs. This configuration is used when the LEDs do not have a wide angle of light output, and helps to smooth out very bright spots.

Figure 5:
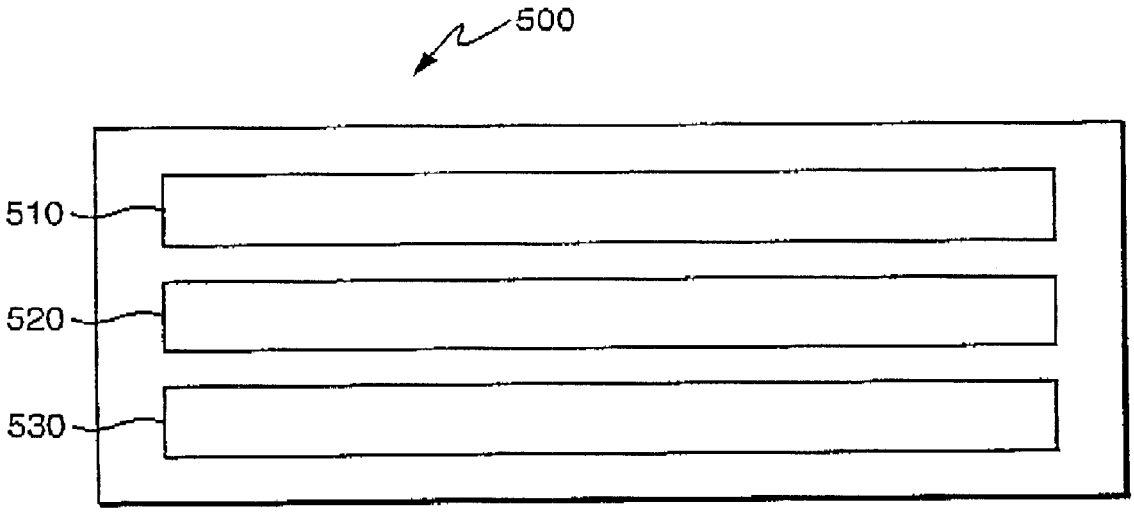
FIG. 5 depicts a front panel of the current invention, showing three display panels, each with a distinct stencil.

FIG. 5 shows a version of the device 500 with three separate display screens which are marked as 510, 510, and 520. Each of these screens has a different stencil, or set of stencils. They can be covered or uncovered for selection of individual visibility, or in different combinations. They may all use the same illuminatable panel, or may each have a separate illuminatable panel corresponding to the screen.

Figure 6:
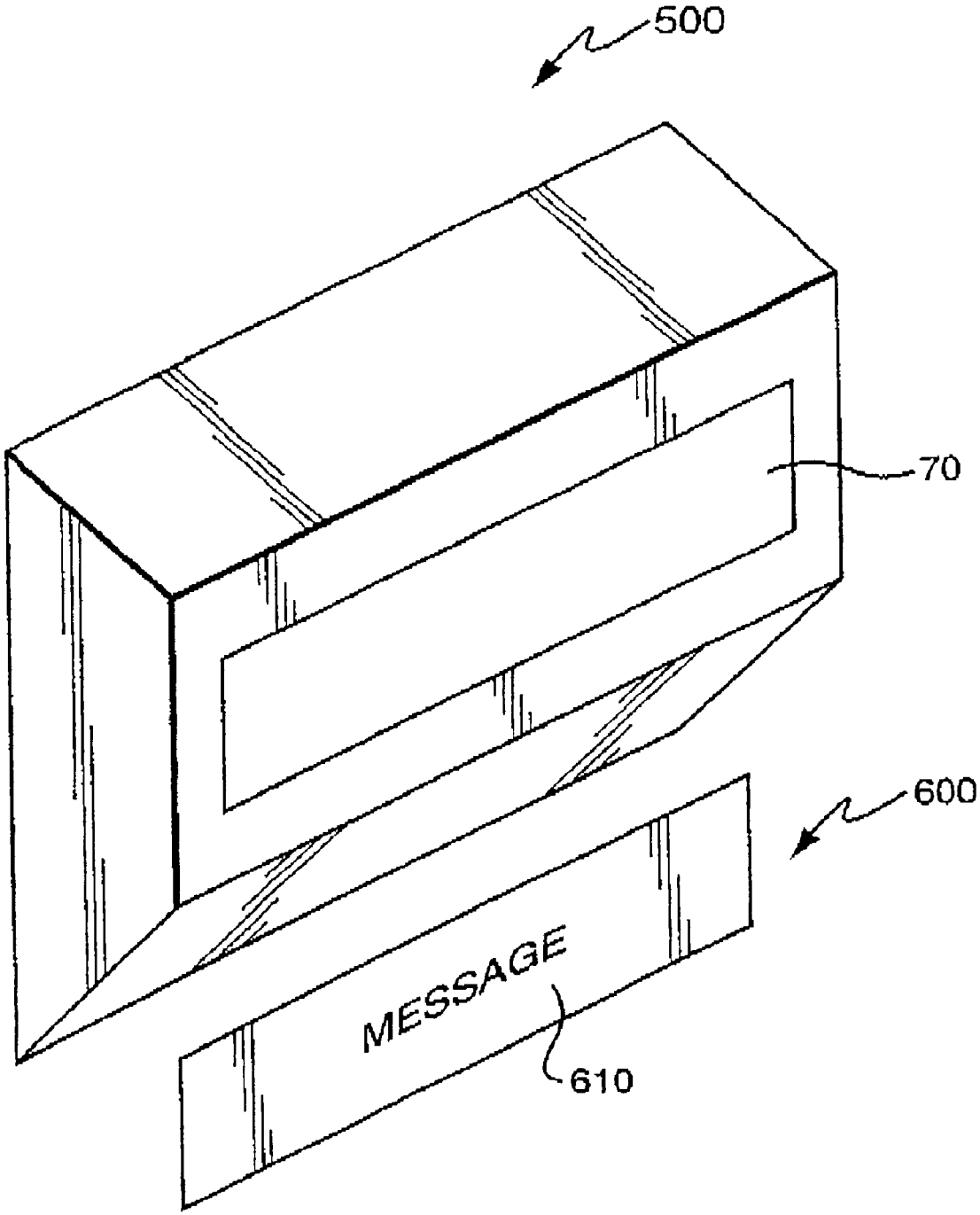
FIG. 6 depicts an exploded view of the current invention, showing a stencil with the rubric "MESSAGE" attached.

FIG. 6 shows the device 500 with an option for the use of an external image overlay 600 that can contain different messages 610.

It should be noted that the techniques described in this embodiment could be used with arrays of LEDs configured to produce symbols which depend on which of them are illuminated. The same power-conserving electronics could be used, as well as using CMOS memory to retain the characters to be displayed, once programmed. However, such a sign would have the appearance of LED character displays, with the common drawback—that is, the appearance of a display made up of spots, or segments, and only approximating the characters desired. The present system, on the other hand, produces characters whose shape and appearance is close to perfect.

While the invention has been described with reference to specific embodiments, it will be apparent that improvements and modifications may be made within the purview of the invention without departing from the scope of the invention defined in the appended claims.

I claim:

1. An illuminated sign, comprising:

(a) one or more batteries;

(b) an illuminatable panel powered by the batteries, and further comprising a multiplicity of LEDs;

switching means which switch the LEDs on and off at a pulse rate beyond the critical flicker fusion frequency; which vary the pulse rate, which cause the LED's to remain on for an on period after being switched on, and which vary the duration of said on period;

(c) light diffusing means disposed in front of the illuminatable panel; and (d) one or more opaque stencils each containing one or more cutouts of a character through which the illuminatable panel is visible, so that the appearance of the sign is of illuminated characters corresponding to the stencils when the illuminatable panel is illuminated.

2. The sign of claim 1, further comprising constant current electronic means to illuminate the LEDs.

3. The sign of claim 2, wherein the sign further comprises:

(a) a dusk detector, (b) timing means which is activated when the dusk detector detects the onset of dusk and remains activated-for an illumination period; and (c) means to control the illumination period, so that said timing means switches power from the batteries to the illuminatable panel off except during the illumination period.

4. The sign of claim 3, further comprising switching means to flash the sign on and off at a rate perceptible to the human eye.

5. The sign of claim 4, wherein the light diffusing means further comprises a panel having a whitish color, so that the cutouts in the stencils are easily visible during daylight hours, when the illuminatable panel is not illuminated.

6. The sign of claim 5, wherein the stencils have a front side and a back side, the front side being dark in color, and the back side having a reflective surface, so that a light from the reflective surface reflects off the light diffusing means, further illuminating the light diffusing means.

7. The sign of claim 6, further comprising a sign body, and slides formed therein and wherein the stencils are retained in the body by the slides.

8. The sign of claim 7, wherein the light diffusing means further comprises a first diffuser plane, in proximity with the illuminatable panel, and a second diffuser plate, having a whitish color, and in proximity with the stencils.

9. An illuminated sign, comprising:

(a) one or more batteries;

(b) an illuminatable panel powered by the batteries, and further comprising a multiplicity of LEDs;

a switch which switches the LEDs on and off at a pulse rate beyond the critical flicker fusion frequency; which vary the pulse rate, which cause the LED's to remain on for an on period after being switched on, and which vary the duration of said on period;

(c) a light diffuser disposed in front of the illuminatable panel; and (d) one or more opaque stencils each containing one or more cutouts of a character through which the illuminatable panel is visible.

so that the appearance of the sign is of illuminated characters corresponding to the stencils when the illuminatable panel is illuminated.

10. The sign of claim 9, further comprising a constant current electronic source to illuminate the LEDs.

11. The sign of claim 10, wherein the sign further comprises:

(a) a dusk detector, (b) a timer which is activated when the dusk detector detects the onset of dusk and remains activated for an illumination period; and (c) a controller to control the illumination period, so that said timer switches power from the batteries to the illuminatable panel off except during the illumination period.

12. The sign of claim 11, further comprising a flasher switch to flash the sign on and off at a rate perceptible to the human eye.

13. The sign of claim 12, wherein the light diffuser further comprises a panel having a whitish color, so that the cutouts in the stencils are easily visible during daylight hours, when the illuminatable panel is not illuminated.

14. The sign of claim 13, wherein the stencils have a front side and a back side, the front side being dark in color, and the back side having a reflective surface, so that a light from the reflective surface reflects off the light diffuser, further illuminating the light diffuser.

15. The sign of claim 14, further comprising a sign body, and slides formed therein and wherein the stencils are retained in the body by the slides.

16. The sign of claim 15, wherein the light diffuser further comprises a first diffuser plane, in proximity with the illuminatable panel, and a second diffuser plate, having a whitish color, and in proximity with the stencils.

* * * * *